US010141661B2

(12) United States Patent
Ahldag

(10) Patent No.: US 10,141,661 B2
(45) Date of Patent: Nov. 27, 2018

(54) CONTACT INSERT OF A SPRING FORCE CONNECTION CLAMP AND SPRING FORCE CONNECTION CLAMP CONFIGURED WITH SAID CONTACT INSERT

(71) Applicant: WAGO Verwaltungsgesellschaft mbH, Minden (DE)

(72) Inventor: Joerg Ahldag, Rinteln (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/631,735

(22) Filed: Jun. 23, 2017

(65) Prior Publication Data

US 2017/0373406 A1 Dec. 28, 2017

(30) Foreign Application Priority Data

Jun. 23, 2016 (DE) ..... 10 2016 111 536

(51) Int. Cl.

| | |
|---|---|
| ***H01R 4/24*** | (2018.01) |
| ***H01R 4/48*** | (2006.01) |
| *H01R 43/16* | (2006.01) |
| *H01R 4/52* | (2006.01) |
| *H01R 13/627* | (2006.01) |

(52) U.S. Cl.

CPC ..... *H01R 4/4827* (2013.01); *H01R 4/489* (2013.01); *H01R 4/4818* (2013.01); *H01R 4/52* (2013.01); *H01R 13/6273* (2013.01); *H01R 43/16* (2013.01)

(58) Field of Classification Search

CPC ..... H01R 4/4818; H01R 4/38; H01R 4/4845; H01R 11/282

USPC ..... 439/441, 815, 828, 829, 834, 835

See application file for complete search history.

(56) References Cited

U.S. PATENT DOCUMENTS

| | | | | | |
|---|---|---|---|---|---|
| 5,454,730 | A * | 10/1995 | Tozuka | H01R 4/4818 | 439/438 |
| 5,938,484 | A * | 8/1999 | Beege | H01R 4/4845 | 439/828 |
| 6,010,376 | A * | 1/2000 | Kollmann | H01R 4/4827 | 439/803 |
| 6,062,918 | A * | 5/2000 | Myer | H01R 13/187 | 439/833 |
| 6,146,186 | A * | 11/2000 | Barrat | H01R 4/2416 | 439/410 |
| 6,350,162 | B1 * | 2/2002 | Despang | H01R 4/4845 | 439/828 |

(Continued)

FOREIGN PATENT DOCUMENTS

| | | |
|---|---|---|
| DE | 198 10 310 C1 | 7/1999 |
| DE | 20 2005 010 991 U1 | 12/2006 |

(Continued)

*Primary Examiner* — Thanh Tam Le

(74) *Attorney, Agent, or Firm* — Muncy, Geissler, Olds & Lowe, P.C.

(57) ABSTRACT

A contact insert of a spring force connection clamp having at least one retaining frame and at least one clamp spring that is mounted in the retaining frame, wherein a spring insert that functions so as to increase the clamping force of the clamp spring is arranged at least within a region that is encompassed by a spring bow of the clamp spring, wherein the spring insert is configured as one piece with the retaining frame. A spring force connection clamp having at least one contact insert of this type is also provided.

12 Claims, 2 Drawing Sheets

(56) References Cited

U.S. PATENT DOCUMENTS

| | | | | |
|---|---|---|---|---|
| 6,776,670 | B2 * | 8/2004 | Suss | H01R 4/4818 439/834 |
| 7,607,956 | B2 * | 10/2009 | Lang | H01R 4/4827 439/728 |
| 7,766,706 | B2 * | 8/2010 | Kawamura | H01R 13/112 439/833 |
| 7,896,686 | B2 * | 3/2011 | Hoppe | H01R 4/4827 439/441 |
| 7,909,633 | B1 * | 3/2011 | Miller | H01R 4/305 439/441 |
| 8,734,192 | B2 * | 5/2014 | He | H01R 4/489 439/815 |
| 8,851,920 | B2 * | 10/2014 | Wu | H01R 4/4827 439/441 |
| 9,502,790 | B2 | 11/2016 | Kollmann et al. | |
| 9,525,217 | B2 | 12/2016 | Kollmann et al. | |

FOREIGN PATENT DOCUMENTS

| | | |
|---|---|---|
| DE | 10 2011 110 640 A1 | 2/2013 |
| DE | 10 2013 101 408 A1 | 8/2014 |
| DE | 20 2013 100 635 U1 | 11/2016 |
| JP | 2009 187 833 A | 8/2009 |

* cited by examiner

CONTACT INSERT OF A SPRING FORCE CONNECTION CLAMP AND SPRING FORCE CONNECTION CLAMP CONFIGURED WITH SAID CONTACT INSERT

This nonprovisional application claims priority under 35 U.S.C. § 119(a) to German Patent Application No. 10 2016 111 536.3, which was filed in Germany on Jun. 23, 2016, and which is herein incorporated by reference.

BACKGROUND OF THE INVENTION

Field of the Invention

The invention relates to a contact insert of a spring force connection clamp having at least one retaining frame and at least one clamp spring that is mounted in the retaining frame, wherein a spring insert that functions so as to increase the clamping force of the clamp spring is arranged at least within a region that is encompassed by a spring bow of the clamp spring. The invention relates moreover to a spring force connection clamp having at least one contact insert of this type.

Description of the Background Art

In general, the invention relates to the field of electrical connection technology by means of spring force clamp connections. Spring force connection clamps having spring force clamp connections are already known for this purpose. An electrical conductor can be fixedly clamped and electrically contacted in general to a current rail solely by means of the force of a clamp spring. If electrical conductors having a large conducting cross section are to be securely clamped, an accordingly large spring force is required. This can be achieved for example by virtue of the fact that the spring is produced from a strip material having a large material thickness. It is possible to simplify the production process in that the clamp spring that is used to clamp the electrical conductor is produced from thinner strip material and the clamping force by means of an additional spring insert that is arranged at least in part in the region that is surrounded by the clamp spring. A spring force connection clamp of this type is disclosed in the WAGO series 285-135 or 285-635.

SUMMARY OF THE INVENTION

It is therefore an object of the invention to simplify a contact insert of a spring force connection clamp with regard to a procedure of assembling individual parts.

In an exemplary embodiment, this object is achieved in the case of a contact insert that the spring insert is configured as one piece with the retaining frame. In an alternative variant, the retaining frame can comprise at least one fastenor for fastening the spring insert to the retaining frame so that the spring insert can also be fastened to the retaining frame without the clamp spring.

In this manner, the procedure of assembling the contact insert and thereby the entire spring force connection clamp is simplified since the spring insert can already be pre-assembled on the retaining frame because said retaining frame comprises a fastenor for fastening the spring insert. The pre-assembled unit of the retaining frame and the spring insert can then be fitted with the clamp spring. The contact insert that is configured in this manner can then be arranged in an insulating material housing in order to form a complete spring force connection clamp.

The assembly procedure is further simplified and improved in that the spring insert is configured as one piece with the retaining frame, for example as a metal part that is configured as one piece for example in the form of a stamped bent part. The procedure of assembling the spring insert on the retaining frame is accordingly omitted. Then only the clamp spring is to be mounted on the retaining frame in order to provide the contact insert or where appropriate to attach another current rail.

Moreover, the expenditure for producing the contact insert and the storage of the components is improved by means of the invention since the diversity of individual parts is reduced. Moreover, the number of tools that are required for the production of the contact insert and for the procedure of assembling the individual parts can be reduced.

The arrangement of the clamp spring having the spring insert inserted therein renders it possible in a simple manner to provide a strong spring force for clamping electrical conductors having large cross sections, for example 35 $mm^2$ or more. A good electrical connection of the electrical conductors to the current rail or other electrical parts of the contact insert is ensured by means of the strong spring force so that the voltage drop at the transition between the electrical conductor and the current rail or the other components can be kept low. The clamp spring and/or the spring insert can be produced from resilient planar material or strip material that comprises a relatively small thickness for example a thickness in the region of 0.4 to 0.8 mm, in particular 0.6 mm. Such resilient material can be processed on a simple, customary stamping-bending machine with little expenditure since comparatively small forming forces are required.

A further advantage of the invention resides in the fact that the use of copper can be kept to a minimum.

The contact insert can be used, for example, for spring force connection clamps in an arbitrary manner, accordingly also for clamp springs that are formed in a fundamentally arbitrary manner, if the clamp springs comprise at least one spring bow. It is possible with the contact insert in accordance with the invention to achieve in particular in a favourable manner a push-in spring force clamping connection. In the case of such a type of spring force clamping connections, an electrical conductor having sufficient rigidity, for example a single-wired conductor or a multi-wired conductor having for example a wire-end sleeve, can be inserted directly into the spring force clamping connection or into the clamping site of said spring force clamping connection without initially having to deflect the clamp spring by means of a tool or an actuating element of the spring force connecting clamp. This is in particular advantageous for the rapid wiring of a large number of electrical conductors.

In accordance with an embodiment of the invention, it is provided that the clamp spring comprises a clamping limb for fixedly clamping an electrical conductor and also comprises a contacting limb by way of which the clamp spring is braced on the retaining frame, wherein the clamping limb is connected to the contacting limb by way of the spring bow. The clamping limb can in particular end with a clamping edge that is used to fixedly clamp a conductor in the contact insert. In this manner, it is possible to transfer proven construction principles of spring force connection clamps to the field of the spring force clamping arrangement of electrical conductors having large cross sections. The clamp spring can in particular be configured in such a manner that the clamping limb and the contacting limb extend essentially parallel to one another and the spring bow subtends an angular region of approximately 180° if a conductor is not fixedly clamped in the contact insert. In this manner, it is possible to use proven, reliable clamp spring constructions, for example in the manner of a loop spring.

In accordance with an embodiment of the invention, it is provided that the retaining frame encompasses a frame interior in an annular manner, wherein the retaining frame comprises a retaining surface, which faces the frame interior, for the mounting region of the contacting limb of the clamp spring and on one side of the retaining frame lying opposite the retaining surface said retaining frame comprises a supporting surface, which faces the frame interior, for the end region of the clamping limb of the clamp spring or a current rail so that the clamp spring can be clamped in the retaining frame between the retaining surface and the supporting surface or the current rail that is lying on the supporting surface so that the clamping limb of the clamp spring lies on the supporting surface or the current rail if a conductor is not fixedly clamped between said clamping limb and supporting surface. In this manner, a reliable retaining and mounting possibility is provided for the clamp spring on the retaining frame. The clamp spring can consequently support itself on one side, in other words using the contacting limb, on the retaining surface, and on the other side, namely using the clamping limb, directly or indirectly by way of the current rail on the supporting surface. Accordingly, a clamping site is provided for the electrical conductor between the clamping limb, in particular the clamping edge of said clamping limb, and the supporting surface or the current rail.

The contact insert can be provided as a contact insert having a separate current rail, in other words a current rail that is provided as a separate component and is clamped by means of the clamping limb on the supporting surface in the retaining frame. The contact insert can also be provided as a contact insert having an integrated current rail, for example in that the retaining frame comprises an integrated current rail. This can be achieved for example by virtue of the fact that a part of the retaining frame, for example a material region that faces the frame interior, is stamped and bent so that said region forms a current rail for supporting the electrical conductor.

If the contact insert comprises a current rail that is configured as a separate component, this current rail can consequently be clamped between the clamping limb and the supporting surface.

The retaining frame consequently forms a type of cage in which the current rail and the clamp spring can be received. The frame interior is in particular entirely encompassed in an annular manner by means of the retaining frame, which has the advantage that a system that is enclosed within itself is provided that forms a self-supporting spring force connection system using the receiving arrangement of a clamp spring that can be configured as a push-in clamp spring.

The contact insert in accordance with the invention is suitable for clamp springs and current rails in many construction types. In particular, it is not necessary to adapt the current rail in a particular manner to the use in the contact insert in accordance with the invention. It is thus not necessary to perform any alterations to the material thickness of the current rails. It is thus possible to use known embodiments of current rails. A current rail piece can be guided in the retaining frame in the lower region of the retaining frame, wherein the current rail piece can be provided in the region of the supporting arrangement in the retaining frame on the one hand bent at an angle and on the other hand having a beading for the end of the clamping limb of the clamp spring.

The frame interior can be encompassed in an annular manner by the retaining frame, for example having a rectangular or square profiled contour. Other geometries of the annular form are possible, for example oval or circular, a rectangular or square shape is however the most common for the function of a spring force connection clamp.

In accordance with an embodiment of the invention, it is provided that the supporting surface is arranged on one side of the frame interior. Accordingly, the frame interior can also be used to form the clamping site for the electrical conductor. Depending upon the embodiment of the contact insert, the retaining frame can also be arranged on one side of the frame interior, for example a side of the frame interior that lies opposite the supporting surface.

In accordance with an embodiment of the invention, the retaining surface is not arranged on one side of the frame interior. The retaining surface can accordingly be arranged in another region of the retaining frame, for example on a separate retaining link so as to mount the clamp spring. If the spring insert is provided as a separate component, said spring insert can comprise a contacting limb that is mounted on one side of the frame interior for example on a side of the frame interior that lies opposite the supporting surface.

In accordance with an embodiment of the invention, it is provided that the spring insert ends with its part that ends in the region of the clamping limb of the clamp spring prior to reaching an end-side clamping edge of the clamping limb. This has the advantage that the spring insert can be embodied from a shorter material piece than the clamp spring since it is not absolutely necessary for said spring insert to exert its supporting spring force over the entire region of the longitudinal extent of the clamp spring. It is possible in this manner to save material. Moreover, the procedure of assembling the contact insert is simplified. A further advantage is that in order to clamp the electrical conductor in the contact insert only the one defined clamping edge of the clamping limb is used so that a mechanically defined arrangement is produced.

In accordance with an embodiment of the invention, it is provided that the retaining frame comprises an extended material piece that is configured as one piece with the retaining frame in the region of the retaining surface, said material piece is curved in a bow shape away from the retaining frame and forms the spring insert. This renders possible a simple and cost-effective production of a retaining frame having an integrated spring insert.

The spring insert can have a comparable shape to the clamp spring, at least in the region of the spring bow and the adjoining region of the contacting limb and the clamping limb.

In accordance with an embodiment of the invention, it is provided that a bent-out link protrudes from the retaining frame, said bent out link being configured so as to retain the contacting limb of the clamp spring. In this manner, a retaining possibility or mounting possibility for the contacting limb of the clamp spring is provided as one piece with the retaining frame. Additional components for fastening the clamp spring to the retaining frame are then not required.

In accordance with an embodiment of the invention, it is provided that the spring insert lies at least in the region of its end-side limb or in the predominantly longitudinal extent region on the inner side of the clamp spring, said inner side being formed between the contacting limb and the clamping limb. In this manner, the spring insert can exert a sufficient supporting force on the clamp spring. It is not necessary for the spring insert to lie at each site on the clamp spring, rather said spring insert can comprises regions that lie on the clamp spring and regions that do not lie on the clamp spring. The spring insert can lie in particular in the region of the spring bow of the clamp spring on said clamp spring.

In accordance with an embodiment of the invention, it is provided that the spring insert comprises on its end that is facing the clamping limb a greater width than the width of the frame interior of the retaining frame and/or the end of the spring insert that is facing the clamping limb is arranged offset with respect to the frame interior. In this manner, it can be prevented that the spring insert can move inwards in the case of a corresponding deflection of the clamp spring as far as into the frame interior. On the contrary, the free end of the spring insert forms a stop on the retaining frame in the region of the clamping limb.

The object mentioned in the introduction is moreover achieved by means of a spring force connection clamp having at least one contact insert of the above-mentioned type. As a consequence, the above mentioned advantages can also be achieved.

The spring force connection clamp can be selectively configured as a spring force connection clamp having a dedicated actuating element for example an actuating lever or actuating button, or without a dedicated actuating element. If a dedicated actuating element is present, the clamping site of the spring force clamp connection can be opened by means of the actuating element, in that the clamping limb is raised from the current rail or a conductor, which is already fixedly clamped, and said clamping limb is bent in the direction of the contacting limb. If the spring force connection clamp does not comprise a dedicated actuating element, the above-mentioned, desired opening of the spring force clamp connection can be performed by means of a tool, for example by means of a screwdriver.

A further advantage is that it is possible by means of the retaining frame to avoid that the spring forces and actuating forces are introduced into a housing of the spring force connecting clamp that encompasses the contact insert. Moreover, a reduction of the friction is possible if the running surface of the actuating element is located directly on the surface of the retaining frame. As a consequence, the actuating force of the actuating element can be reduced.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
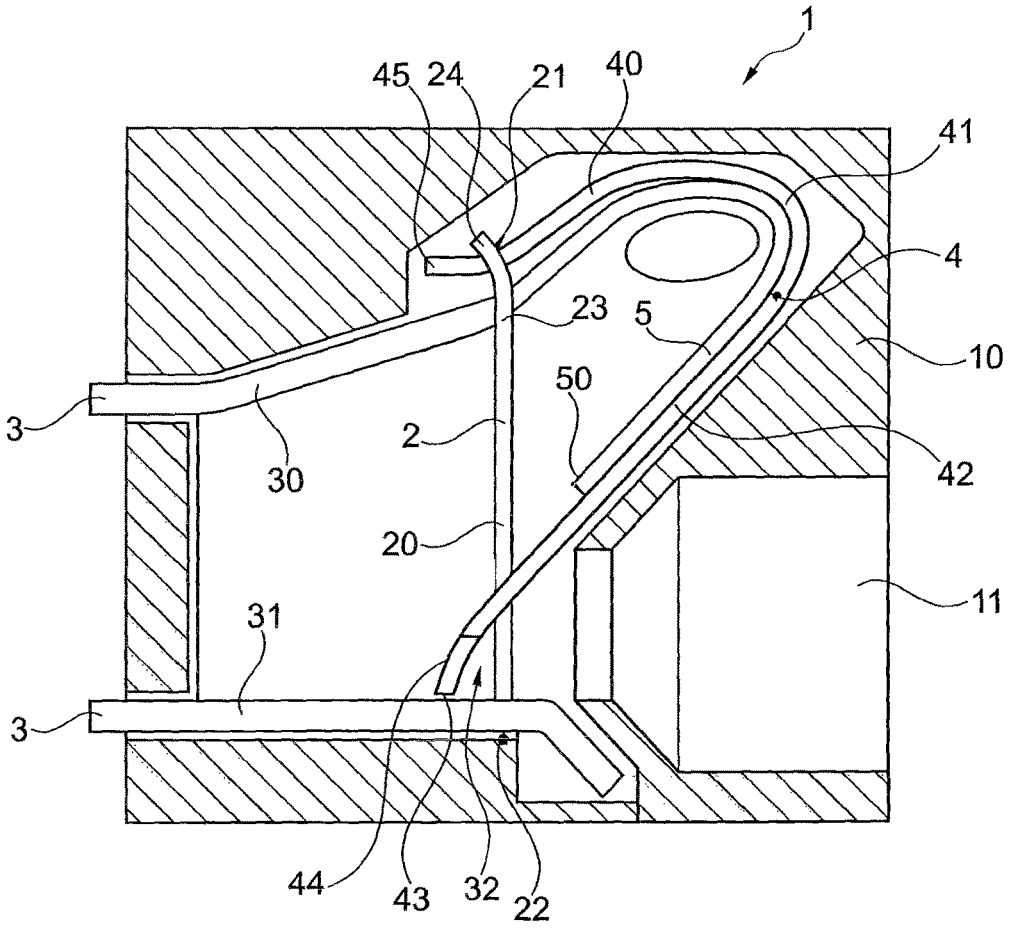
FIG. 1 illustrates a spring force connection clamp in a sectional view from the side and FIG. 2 illustrates the retaining frame of the spring force connection clamp in accordance with FIG. 1 in a perspective view.

FIG. 1 illustrates a spring force connection clamp 1 having an insulating material housing 10, into which insulating material housing a contact insert in accordance with the invention is inserted. The contact insert comprises the following as components that are in each case produced from metal: a retaining frame 2, a current rail arrangement 3 having current rails 30, 31, a clamp spring 4, a spring insert 5.

Figure 2:
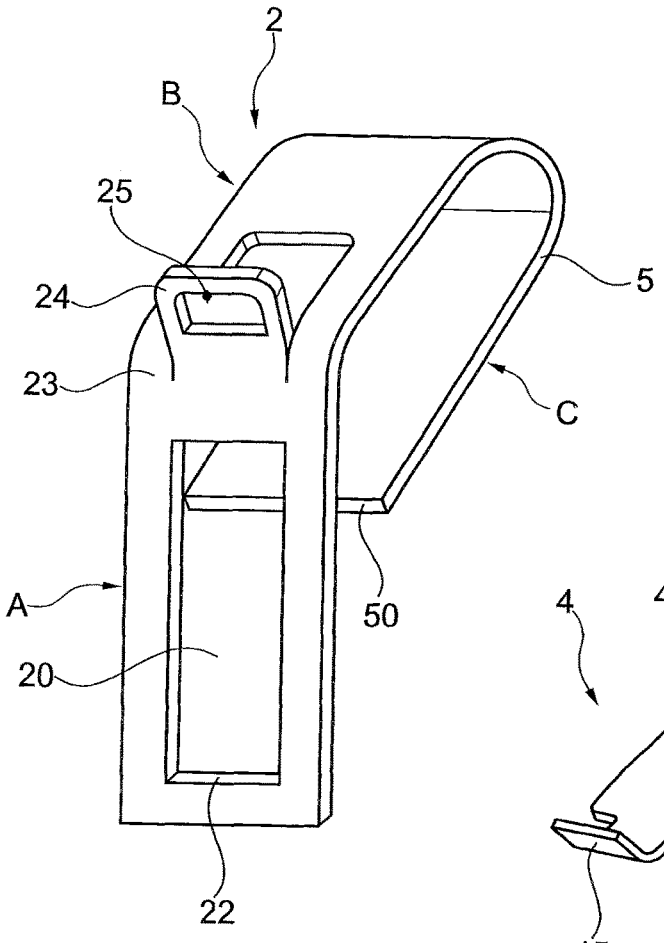

Initially, the retaining frame 2 is to be further explained, and in fact with simultaneous reference to FIGS. 1 and 2. The retaining frame 2 is produced as one piece with the spring insert 5 from a sheet metal part that is strip-shaped or in strip form. The part of the retaining frame 2 that is essential for the retaining function is formed in a lower, vertically-extending section A of the sheet metal part and said part of said retaining frame comprises a frame interior 20 that is encompassed by the material of the retaining frame 2 in an annular manner. In the upper region, the section A transitions into a section B that is bent at an incline or approximately at a right angle from the section A and said section B transitions by way of a bow-shaped region into an end-side section C of the sheet metal part. The spring insert 5 is formed as one piece with the retaining frame 2 by means of the material of the sheet metal part from section B to section C.

The retaining frame 2 comprises in the retaining frame interior 20 on one side a supporting surface 22 and the current rail 31 is mounted on said supporting surface and lies on the supporting surface 22.

A link 24 is bent out of the sheet metal part in the transition region from section A into section B, for example by means of stamping and bending, wherein the link 24 comprises a window-type cut-out region and a retaining surface 25 for mounting a contacting limb 40 of the clamp spring 4 is provided on one inner side of said cut-out region.

The sheet metal part is formed in the region of the spring insert 5 in an essentially identical manner as the clamp spring 4, at least in essential regions of the contacting limb, of a rearward spring bow 41 and a clamping limb 42.

The spring insert 5 ends in the section C with an end edge 50 that is, as is evident, wider than the width of the frame interior 20. In this manner, the end edge 50 is a stop for the spring insert 5 if it is deflected in the direction of the retaining frame 2.

Figure 3:
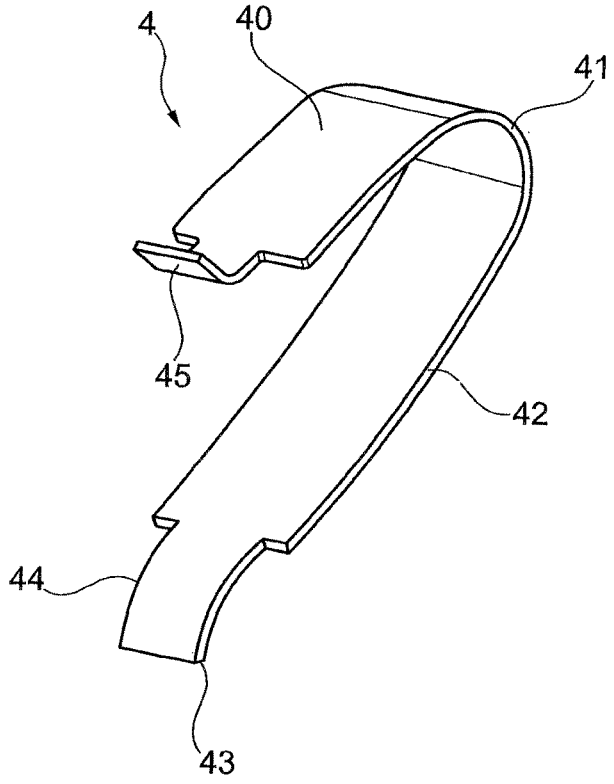
FIG. 3 illustrates the clamp spring of the spring force connection clamp in accordance with FIG. 1 in the perspective view.

The clamp spring 4 that is explained with reference to FIGS. 1 and 3 comprises a contacting limb 40, a rearward spring bow 41 that connects to said contacting limb and a clamping limb 42 that connects to said spring bow 41. The contacting limb 40 extends on the end side in a narrower mounting region 45 that can be inserted into the cut-out of the link 24 and can be mounted on the retaining surface 25. For this purpose, the mounting region 45 is bent upwards in relation to the spring bow 41 opposite the bending direction so to speak.

The clamp spring 4 ends in the region of the clamping limb 42 with a clamping edge 43 that is arranged in an end region 44 of the clamp spring, said end region being bent slightly downwards. The end region 44 is configured as a little narrower than the other regions of the clamping limb 42 since this end region 44 is inserted through the opening in the retaining frame 2, in other words into the frame interior 20 in order to be held either on the supporting surface 22 or, as is illustrated in FIG. 1, by means of the current rail 31.

An electrical conductor can be inserted into the spring force connection clamp 1 by means of a conductor insertion opening 21 and is then clamped between the clamping edge 43 of the clamp spring 4 and the current rail 31. Accordingly, a clamping site 32 of the spring force connection clamp 1 is formed between the clamping edge 43 and the current rail 31.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact insert of a spring force connection clamp comprising:

at least one retaining frame;

at least one clamp spring that is mounted in the retaining frame; and a spring insert that increases a clamping force of the clamp spring is arranged at least within a region that is encompassed by a spring bow of the clamp spring, the spring insert being configured as one piece with the retaining frame, wherein the clamp spring comprises a clamping limb for fixedly clamping an electrical conductor and also comprises a contacting limb via which the clamp spring is supported on the retaining frame, and wherein the clamping limb is connected via the spring bow to the contacting limb, and wherein a link that is bent out and protrudes from the retaining frame is provided, the link being configured so as to retain the contacting limb of the clamp spring by including a retaining surface therein that supports the contacting limb of the clamp spring.

2. The contact insert according to claim 1, wherein the retaining frame annularly encompasses a frame interior, wherein the retaining frame comprises the retaining surface for supporting the contacting limb of the clamp spring, and on a side of the retaining frame that lies opposite the retaining surface, the retaining frame comprises a supporting surface, which faces the frame interior, the supporting surface for supporting the clamping limb of the clamp spring or a current rail, so that the clamp spring is adapted to be clamped in the retaining frame between the retaining surface and the supporting surface or the current rail that lies on the supporting surface so that the clamping limb of the clamp spring lies on the supporting surface or the current rail if a conductor is not clamped between the clamping limb and supporting surface.

3. The contact insert according to claim 2, wherein the supporting surface is arranged on one side of the frame interior.

4. The contact insert according to claim 2, wherein the spring insert comprises an end side section that faces the clamping limb, the end side section having a greater width than a width of the frame interior of the retaining frame and/or wherein an end side section of the spring insert that is facing the clamping limb is offset with respect to the frame interior.

5. The contact insert according to claim 1, wherein the spring insert has an end side section that terminates in a region of the clamping limb of the clamp spring prior to reaching an end-side clamping edge of the clamping limb.

6. The contact insert according to claim 1, wherein the spring insert is configured as one piece with the retaining frame, the spring insert being bent in a bow shape away from the retaining frame.

7. The contact insert according to claim 1, wherein the spring insert lies at least in a region of its end-side limb or in a predominantly longitudinal extent region on an inner side of the clamp spring that is formed between the contacting limb and the clamping limb.

8. A spring force connection clamp comprising at least one contact insert according to claim 1.

9. The contact insert according to claim 1, wherein the retaining frame includes a vertically extending section having a frame interior, the frame interior including an elongated opening, wherein the elongated opening extends between an upper surface of the frame interior and an opposing lower surface of the frame interior, the opposing lower surface forming a supporting surface, wherein the retaining frame includes a bent section that extends from an upper end of the vertically extending section, the bent section having the link and the link including a window cut-out, the window cut-out having the retaining surface, and wherein the clamping limb of the clamp spring and a current rail extend through the elongated opening and are supported on the supporting surface of the frame interior of the vertically extending section and the contacting limb of the clamp spring extends through the window cut-out of the bent section and is supported on the retaining surface of the window cut-out, so that the clamp spring is clamped in the retaining frame.

10. The contact insert according to claim 9, wherein a portion of the clamping limb that extends through the elongated opening is bent and is narrower than other portions of the clamping limb.

11. The contact insert according to claim 9, wherein a portion of the contacting limb that extends through the window cut-out is bent and is narrower than other portions of the contacting limb.

12. The contact insert according to claim 1, wherein the link includes a window cut-out.

* * * * *